United States Patent [19]

Bezler et al.

[11] Patent Number: 4,696,229

[45] Date of Patent: Sep. 29, 1987

[54] ROTARY OFFSET PRINTING PRESS EQUIPPED FOR FLYING PLATE CHANGE

[75] Inventors: Wilhelm Bezler, Augsburg; Ingo Kobler, Anhausen, both of Fed. Rep. of Germany

[73] Assignee: M.A.N.-Roland Druckmaschinen Aktiengesellschaft, Offenbach am Main, Fed. Rep. of Germany

[21] Appl. No.: 843,988

[22] Filed: Mar. 25, 1986

[30] Foreign Application Priority Data

Mar. 26, 1985 [DE] Fed. Rep. of Germany ..... 3510822
Mar. 26, 1985 [DE] Fed. Rep. of Germany ..... 3510823

[51] Int. Cl.[4] ..... B41F 5/04; B41F 5/22
[52] U.S. Cl. ..... 101/177; 101/220
[58] Field of Search ..... 101/177, 179, 180, 181, 101/182, 220, 221, 225, 217, 218, 137, 138, 139, 143, 144, 142

[56] References Cited

U.S. PATENT DOCUMENTS

| | | | |
|---|---|---|---|
| 1,301,072 | 4/1919 | Mascord | 101/247 |
| 1,654,058 | 12/1927 | Smith | 101/247 X |
| 3,329,086 | 7/1967 | Pullen | 101/177 |
| 4,250,809 | 2/1981 | Pullen . | |
| 4,394,835 | 7/1983 | Gertsch et al. | 101/177 |
| 4,398,464 | 8/1983 | Morbitzer et al. | 101/177 |

FOREIGN PATENT DOCUMENTS

| | | | |
|---|---|---|---|
| 123866 | 4/1947 | Australia | 101/221 |
| 386170 | 1/1933 | United Kingdom | 101/221 |
| 384117 | 11/1933 | United Kingdom | 101/221 |

*Primary Examiner*—J. Reed Fisher
*Attorney, Agent, or Firm*—Frishauf, Holtz, Goodman & Woodward

[57] ABSTRACT

A rotary offset printing press which can be operated either for prime and verso printing or for printing on one side only, with flying plate change in the latter case, is organized so that the common counterpressure roller used with either of the two pairs of printing rollers (plate roller and rubber cloth roller) is used only as a paper feed-out guide during prime and verso printing. The counterpressure cylinder can be shifted to let it assume its normal function in single-side printing. A small shift of the drive gearing makes it possible to use the counterpressure cylinder for one or the other pair of printing rollers selectively while a plate change is performed for the idle pair.

6 Claims, 12 Drawing Figures

ROTARY OFFSET PRINTING PRESS EQUIPPED FOR FLYING PLATE CHANGE

This invention concerns a rotary offset printing press equipped with several printing rollers backed with backing rollers in which a strip of material to be printed can be printed on both sides and in which there is also equipment for changing plates without stopping the press while the printing press continues to print on one side, one offset printing roller pair consisting of plate cylinder and rubber cloth cylinder being stopped for the plate change while the other pair operates bearing against a counterpressure cylinder common to both offset-printing roller pairs.

A rotary offset press is known from a propectus entitled "Albert A101" of the Albert Frankenthal firm distributed at the "DRUPA" 1982 exhibition in which a number of press stages or works were arranged one behind the other and a strip of material to be printed can be printed on both sides with ink. The first stage, a so-called single-impression press, includes a doublesize common counterpressure cylinder against which at all times one rubber cloth cylinder and plate cylinder pair is engaged while the other rubber cloth and plate cylinder pair can be prepared for a change of plate. This known press has the disadvantage that a separate specially designed press is needed for the single impression with flying plate change (i.e. plate change without stopping the press).

SUMMARY OF THE INVENTION

It is the object of the invention to improve at least one printing roller pair of a rotary-offset printing machine having at least two printing roller pairs for prime and verso printing in such a way that not only is prime and verso printing operable in the conventional way, but also the printing press can be used for single-side printing with so-called "flying" plate change and, moreover, the gear wheel train for driving the printing press in its various modes of operation can be disposed all at one side of the printing press machinery.

Briefly, in prime and verso operation, the counterpressure cylinder used as such in single-side printing operates only as a paper strip guide roller for the strip that comes out printed from between the rubber-cloth-surfaced cylinders. In single-side printing with flying plate change, the counter pressure cylinder is in contact with one or the other of the rubber cloth cylinders adjacent thereto while the drive of the idle combination of plate cylinder and rubber cloth cylinder is decoupled from the rotary force derived from the main drive and available through the counterpressure cylinder. An auxiliary drive for the flying plate change is connectable selectively with one of the plate cylinders.

In a first embodiment, two spur gears are mounted on the axle of the counterpressure cylinder for connecting the main drive selectively over clutches with one or both of the rubber-cloth-surfaced cylinder drive gears. One of the rubber-cloth-surfaced cylinders has a drive gear engaged with a drive gear of a plate cylinder that is of double width and is axially shiftable. Preferably, one of the rubber-cloth-surfaced cylinders has two drive gears, one of which meshes with the counterpressure cylinder and the other with the shiftable spur gear of the other rubber-cloth-surfaced cylinder. Preferably in both modes of operation, the drive gears of the rubber-cloth-surfaced cylinders remain engaged.

In a second embodiment in prime and verso printing operation, the drive for the plate and rubber cloth cylinders derived from the main drive is applied to one plate cylinder through a gear. The counterpressure cylinder is driven by the main drive over a second gear. In single-impression printing the drive shafts for the rubber cloth cylinders are selectively connectable with another drive gear through couplings with drive gears for the rubber cloth cylinders that are, in this mode of operation, necessarily backed away from each other. The gears with which the drive shafts of the rubber cloth cylinders are selectively connectable are both connected to the drive gear of the counterpressure cylinder and the drive gear for the plate cylinder is out of engagement with the gear of the main drive.

In single-impression operation, again, an auxiliary drive is used to which the plate cylinders can be connected during single-impression operation through couplings to gears of the auxiliary drive, one of these gears being wider than the other in the second embodiment.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
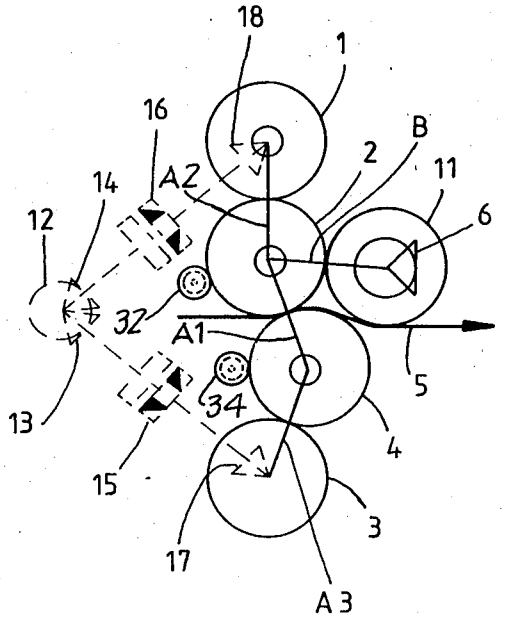
FIG. 1 is an end view diagram of the cylinder array of a first embodiment of the printing press of the invention for prime and verso operation.

FIG. 1 shows the cylinder arrangement of the first press unit of a rotary offset printing machine that has several press stacks for prime and verso printing operated in tandem on the same paper strip, the other following press units not being shown in the drawing. The illustrated printing press unit comprises a first cylinder pair consisting of a plate cylinder 1 and a rubber cloth cylinder 2 and a second cylinder pair, consisting of a plate cylinder 3 and a rubber cloth cylinder 4. In such a printing system a strip of material to be printed is usually printed on both sides in passing between the rubber cloth cylinders 2 and 4, i.e. provided with prime and verso printing.

In this first embodiment, in the case of the type of operation just mentioned, the main drive for the cylinders 1 to 4 delivers rotary force from a gear 7 through conical gearing to a gear 6 which, like the other gear wheels used, is preferably obliquely toothed. The gear 6 is seated on a shaft 8 (FIG. 3) on which there are also mounted two releasable couplings (clutches) 9 and 10. The shaft 8 is flush with the axle of a counterpressure cylinder 11 which is common to the rubber cloth cylinders 2 and 4 or may instead be identical (integral) with that axle. Two spur gears 11' and 11" are mounted on the shaft 8 in such a manner that the clutches 9 and 10 can selectively fix one or the other of them to the shaft 8 for rotation.

Figure 2:
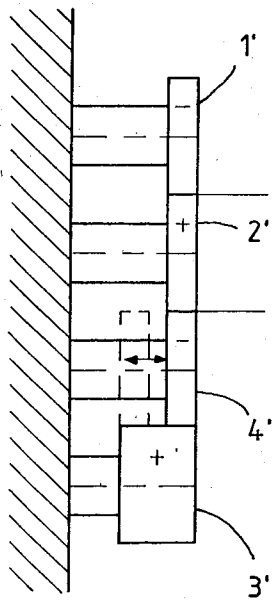
FIG. 2 is a side view diagram of the gearing interconnecting the plate and rubber-cloth-surfaced cylinder.

FIG. 2 shows the gear train of the cylinders 1 to 4 at one side of the printing press machine. The drive is put into operation advantageously, from the main drive outwards, by actuation of the clutch 9 in such a way that the gear 11' is driven by the conical gear 6. The gear 11' meshes with the gear 2' on the axle of the rubber cloth cylinder 2. This gear 2' mounted on the axle of rubber cloth cylinder 2 then transfers the drive directly to the plate cylinder 1 by meshing with the drive gear 1' of the plate cylinder and likewise, by meshing with the drive gear 4', to the rubber cloth cylinder 4. The double-width spur gear 3' of the plate cylinder 3 likewise meshes with the gear 4', so that the cylinders 1 to 4 can all be driven by the main drive in the prime and verso operation illustrated in FIG. 1. The drive transmits force, as shown in FIG. 1, from B to A1 and A2 and then from A1 to A3. The lines so identified in the drawing thus are symbolic of the transmission of rotary force from one axle to another.

The counterpressure cylinder 11 advantageously operates as a paper guide roller for the strip 5 being printed in normal prime and verso printing operation. In this manner of operation it is also possible to back away the counterpressure cylinder 11, serving as paper guide roller, slightly from the rubber cloth cylinder 2. In this operation it is already spaced from the rubber cloth cylinder 4. The usual positioning eccentric adjustments are used for bringing cylinders together or backing them off from each other as above mentioned. Electric motors 32 and 34 equipped with limit switches (not shown) serve respectively to operate the eccentric axle locators of the cylinders 2 and 4. The practical details of the means for swinging the cylinders 2 and 4 in an arc (in rolling contact with their respective plate cylinders 1 and 3) are shown in U.S. Pat. No. 4,250,809, issued Feb. 17, 1981, to Pullen, especially in FIG. 5 and in col. 4, line 22, to col. 5, line 34 thereof, the disclosure of which is hereby incorporated by reference.

Figure 4:
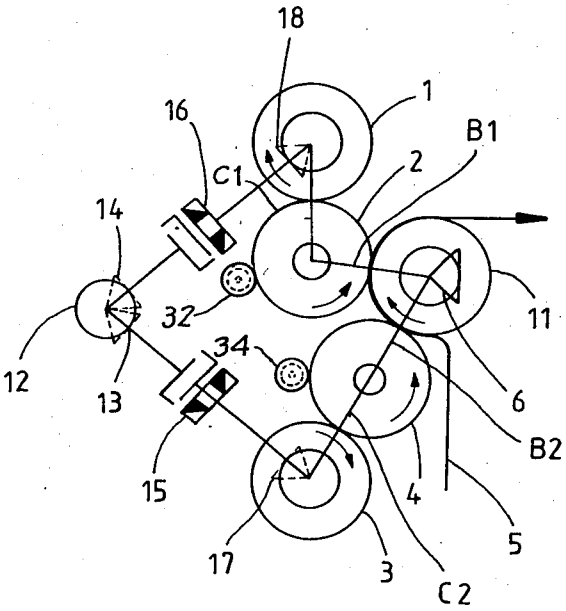
FIG. 4 is an end view diagram corresponding to FIG. 1 for the disposition of the printing press of the invention as a single-impression press with flying plate change.

According to the invention, in addition to the manner of operation illustrated in FIG. 1, the printing press unit of the illustrated first embodiment can also be set up as a single-impression printing press with flying plate change. This is schematically shown in FIG. 4. In this case, the strip to be printed is not passed between the two rubber cloth cylinders 2 and 4, but instead is partly passed around the counterpressure cylinder 11. In this manner of operation also the main drive operates through the counterpressure cylinder 11 or rather over the gears 11' and 11" connected to that cylinder. According to whether the upper cylinders 1 and 2 are to be stopped in order to make a plate change at the plate cylinder 1 or whether this should be done for the lower cylinders 3 and 4, either the gear 11' of the gear 11" is released from the shaft 8 by means of the clutches 9 or 10 as the case may be. Thus either only the gears 2' and 1' and thereby the cylinders 2 and 1 are driven by the conical gear 6, i.e. by the main drive 7, 8, or else the gears 11', 4' and 3' and thereby the cylinders 4 and 3 are similarly driven.

Merely the gear 4' needs to be shifted, as indicated in FIGS. 2 and 4. The now undriven plate cylinder 1 or 3 with its associated rubber cloth cylinder can be stopped for a plate change. After the plate change is performed, the cylinder, for example the plate cylinder 1, is put into motion and accelerated by the auxiliary drive 12 through a conical gear 14, a clutch 16 and another conical gear 18 until it reaches the rate of rotation corresponding to the speed of the main drive, with which it is then synchronized. In this case the clutch 15 separates and isolates the auxiliary drive from the lower plate cylinder 3. A known conventional electronic circuit for the purpose makes sure that the auxiliary drive is connected, after corresponding preparatory operations, with either the plate cylinder 1 or the plate cylinder 3. After the acceleration and synchronizing operations have been successfully performed with the auxiliary drive 12, the cylinders 1 and 2 can be brought into driving engagement with the counterpressure cylinder 11, i.e., the rubber cloth cylinder 2 can be put into engaged position against the counterpressure cylinder 11 by actuation of the positioning eccentric performed by the positioning motor 32.

In the converse case, the main drive 6, 7 can be separated and isolated from the cylinder pair 3 and 4 by actuation of the clutch 10 and the gear 4' shifted again. After a corresponding plate change at the plate cylinder 3, the auxiliary drive acting through a conical gear 13 of the coupling 15 and another conical gear 17 accelerates and synchronizes the plate cylinder 3 and therewith the rubber cloth cylinder 4 to the operating speed. Thereafter, these are brought to bear against the counterpressure cylinder 11 in the same way as previously described. As shown in FIG. 2, the drive then takes effect through B1 and C2 or B2 and C1.

Figure 3:
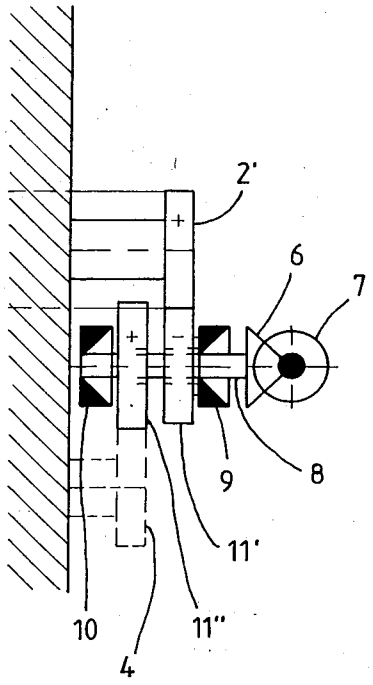
FIG. 3 is a side view diagram of gearing and coupling interconnecting the main drive with the rubber-cloth-surfaced cylinders in the arrangement of FIG. 1.
Figure 5:
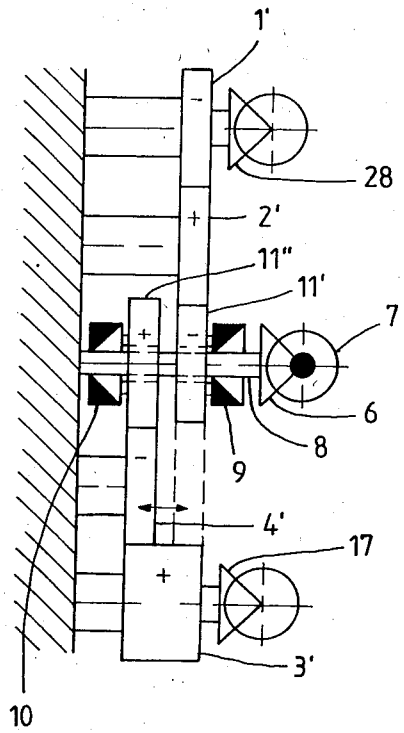
FIG. 5 is a side view diagram of the gear train for operation of the press in the configuration of FIG. 4.

It is important for the offset printing press of the invention that a profile shift or modification should be provided on the drive gear wheels that are used. As illustrated in FIGS. 2, 3 and 5, the gears 1', 4' and 11' are provided with a negative profile modification, while the gears 2", 2', 11" and 3' have a positive profile modification.

Figure 6:
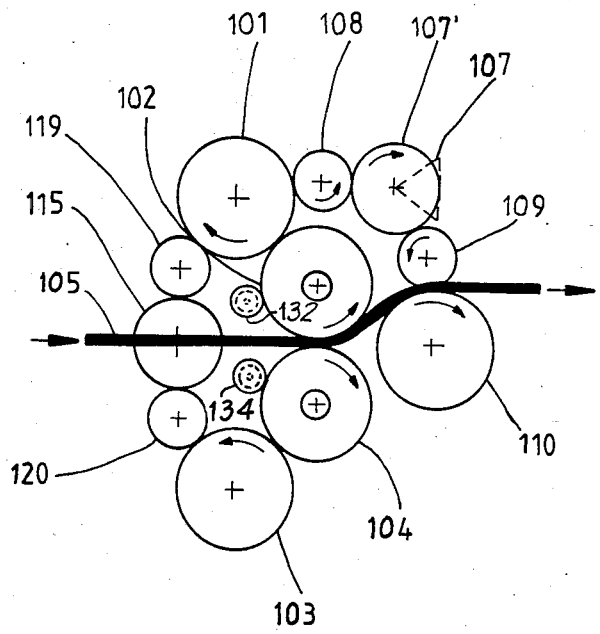
FIG. 6 is a diagrammatic end view diagram of a second embodiment of an offset printing press of the invention in prime and verso printing operation.
Figure 7:
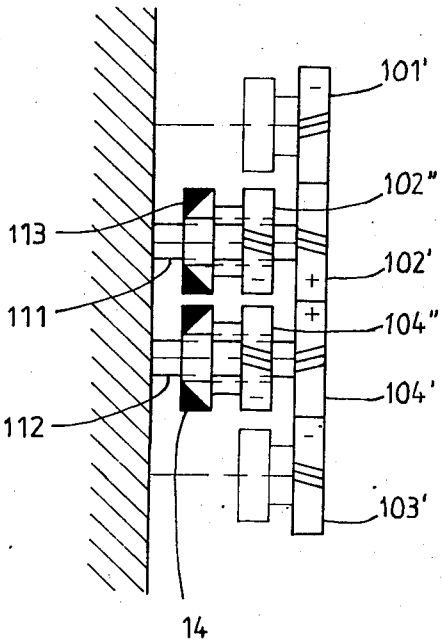
FIG. 7 is a diagram, viewed in a direction at right angles to that of FIG. 1, of the gears for driving the plate cylinders and the rubber cloth cylinders of FIG. 6.

FIG. 6 schematically shows the disposition of the rotary offset press of the second embodiment for prime and verso printing (two-sided printing). There is shown a plate cylinder 101 working with a rubber cloth cylinder 102 and another plate cylinder 103 working with a rubber cloth cylinder 104. The strip 105 which is passed between the two rubber cloth cylinders 102 and 104 is printed on both sides by them. In accordance with the invention, in this operation the drive is provided from the main drive 106, 107 (FIG. 8) through a gear 108 to the drive for the plate cylinder 101, while a common counterpressure cylinder 110, which in this kind of operation merely fulfills the function of guiding the paper strip out of the press, is driven through a gear 109. FIG. 7 shows the axle ends 111 and 112 of the respective rubber cloth cylinders 102 and 104 on which the couplings 113 and 114 are respectively provided. These couplings hold the gears 102" and 104" fixed with respect to the axle ends 111 and 112 of the rubber cloth cylinders during the kind of operation illustrated in FIG. 1. This has no particular significance in this manner of operation.

Figure 8:
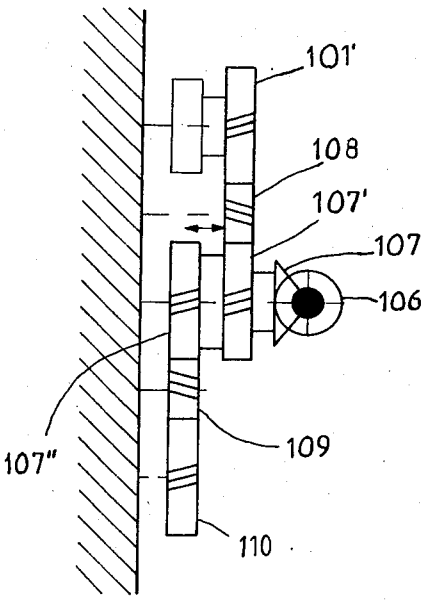
FIG. 8 is a diagram of the same kind as FIG. 7 showing the connection of the main drive to one of the gears of FIG. 7 and the gear for driving the common counterpressure cylinder of FIG. 6.

FIG. 8 shows the drive from the main drive 106, 107 to the gear 101' for the plate cylinder 101 through the gear 107' and the gear 108, the latter being capable of being slipped out of its place axially to disengage this drive, and the drive of the counterpressure cylinder 110 through the gear 107" and the gear 109.

Figure 9:
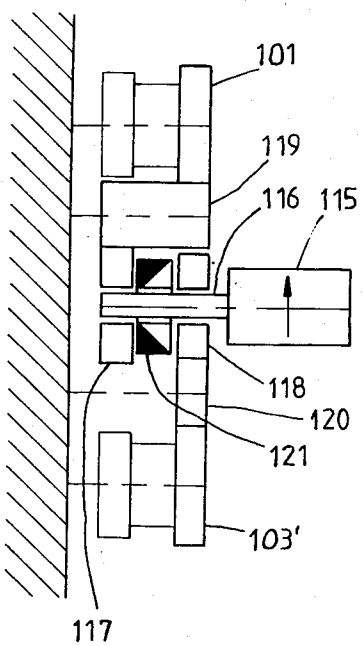
FIG. 9 is a diagram similar to FIGS. 7 and 8 showing an auxiliary drive connectable to either one of the drive gears of the plate cylinders.
Figure 10:
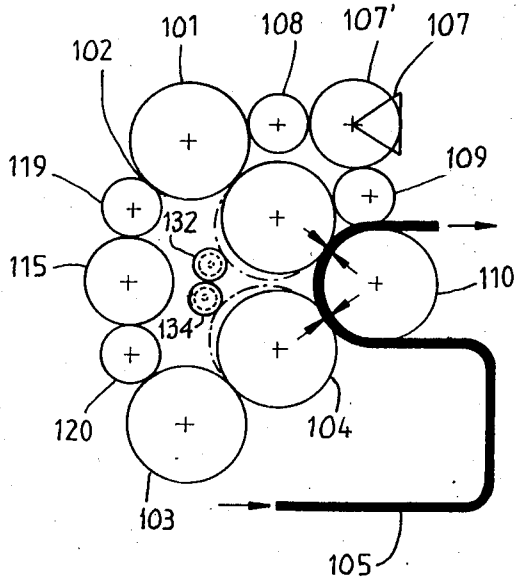
FIG. 10 is a diagram similar to FIG. 6 showing the press of FIG. 6 as used for single-impression printing with flying plate change.

An auxiliary drive for the flying plate change is shown in FIG. 9. This contains a motor 115 which drives a shaft 16 on which the couplings 117 and 118 are provided. This auxiliary drive and flying plate change, as above mentioned, is for single-impression operation (one-side printing). A gear 119 of double width and a gear 120 of normal width are provided for driving either the plate cylinder 101 or the plate cylinder 103 by the auxiliary motor according to whether the coupling 117 or the coupling 118 is actuated. The organization of the cylinders of the press for flying change of printing plates is illustrated in FIG. 10. In this case, either the rubber cloth cylinder 102 or the rubber cloth cylinder 104 is put in engagement with the counterpressure cylinder 110 around which the printing carrier strip 105 passes. When one printing cylinder pair, for example the lower plate cylinder 103 and its rubber cloth cylinder 104, backed off from the common counterpressure cylinder 110, a plate change can take place for the plate cylinder of the pair. After the preparation for printing with the new plate is complete, the plate cylinder 103 and therewith the rubber cloth cylinder 104 are accelerated into synchronism with the main drive 106, 107 by actuating the couplings 118 for driving by the auxiliary motor 115, through the gear 120. When the desired speed is reached, the cylinder 103 and the cylinder 104 can be coupled without difficulty to the common counterpressure cylinder 110. In the same way, the cylinders 101 and 102 can be backed off from the counterpressure cylinder 110 and after a plate change has been performed for the plate cylinder 101, it can likewise, along with its rubber cloth cylinder 102, be brought up to the speed of the main drive by means of the auxiliary drive 115 by actuating the coupling 117 and utilizing the gear 119. In the same way, they can be brought to bear without trouble against the strip to be printed and the counterpressure cylinder 110. The duplicate gears not identified with reference numerals which are shown in FIG. 9 on the shaft of the plate cylinders 101 and 103 respectively near the gears 101' and 103', are for driving the inking mechanism (not shown).

Figure 12:
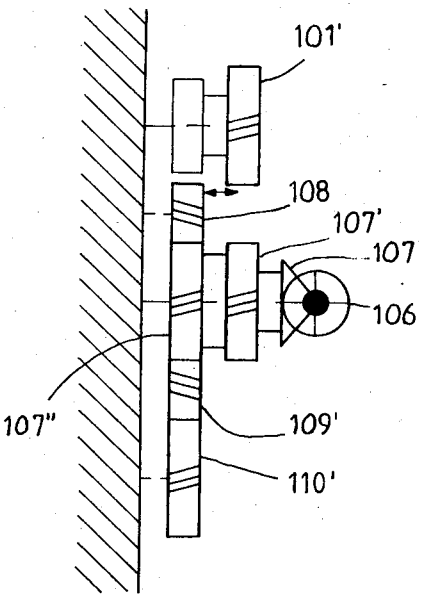
FIG. 12 is a diagram like FIG. 8 for showing the connection of the main drive to one of the plate cylinders and to the counterpressure cylinder during operation of the press in configuration of FIG. 10.
Figure 11:
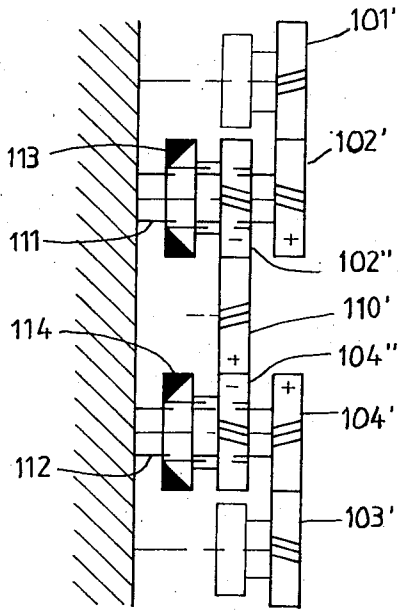
FIG. 11 is a diagram like FIG. 7 for showing the drive of the plate cylinders and rubber cloth cylinders in operation according to FIG. 10.

The gearing shown in FIG. 11 serves the manner of operation of the press shown in FIG. 10 in such a way that the gear 110' of the counterpressure cylinder 110 is located in the position necessary for engaging with the gears 102" and 104" on rubber cloth cylinder axle ends 111 and 112. Then, by actuation of one of the couplings 114 or 113, there can be coupled selectively either the gear 102" on the axle 111 of the rubber cloth cylinder 102 or the gear 104" on the axle 112 of the rubber cloth cylinder 104. In this way, the main drive 106, 107 can drive the counterpressure cylinder 110 through the gear 110' and also either the upper cylinder pair 101, 102 or the lower cylinder pair 103, 104. A plate change can be carried out for the idle cylinder pair that has been uncoupled from the main drive 106, 107. Thereafter, by actuating one of the couplings 117 or 118, the cylinder pair which has been given the plate change can then be brought up to the operating speed of the press. For the shift over the operation shown in FIG. 10, the gear 108 must be shifted from the position shown in FIG. 8 to the position shown in FIG. 12, which means that no further connection between the plate cylinder 101 and the main drive 106, 107 may remain, since now in flying plate change either the upper plate cylinder 101 with the rubber cloth cylinder 102 or the lower plate cylinder 103 with the rubber cloth cylinder 104 has to be, selectively, driven through the gear 110' of the counterpressure cylinder 110 by putting into operation the corresponding coupling 114 or 113. As shown in FIG. 12, the drive gear 107" of the main drive and the gear 109' to the gear 110' of the counterpressure cylinder. The same is also the case in the arrangement of FIG. 8 two sided printing.

As is shown in FIGS. 7–9, 11 and 12, moreover, the entire drive for both kinds of operation can be located, as in the first embodiment, on one side of the printing press machinery.

For producing the necessary shifts to bring together or space apart the rubber cloth cylinders and to separate the counterpressure cylinder from one or the other or both of the rubber cloth cylinders the usual eccentric type axle shifts are used, symbolically represented in the drawings by the actuating motors 132 and 134 corresponding to the motors 32 and 34 of FIGS. 1 and 4. It is not necessary to shift the axle of the counterpressure cylinder 110 to change the configuration of FIG. 6 to that of FIG. 10 or vice versa, but of course its axle could also be shifted in the same manner supplementarily, or in the same manner supplementarily, or in place of one of the other axle shifts, if desired.

Although the invention has been described with reference to a particular illustrative example, it will be recognized that variations and modifications are possible within the inventive concept.

As a matter of terminology, the counterpressure cylinders 11 and 110 are commonly called "impression cylinders" and the rubber-cloth cylinders 2, 4, 102 and 104 are commonly called "blanket cylinders" in the offset printing art. The terms used herein for these cylinders are no less inclusive than the common appellations mentioned in this paragraph.

What is claimed is:

1. Rotary off-set printing press utilizing a multiple array of roller cylinders capable of dual-mode selective operation, either as a prime and verso offset-printing press in which a strip to be printed may be printed simultaneously on both sides or else as a single-side printing press equipped for changing plates on the plate cylinder of a first pair of offset-printing cylinders while the press continues uninterruptedly to print with a second pair of offset-printing cylinders against a counterpressure cylinder common to both pairs of offset-printing cylinders, each of said cylinder pairs including a plate cylinder and a rubber-cloth surfaced cylinder, and comprising, in addition to said pairs of cylinders and said counterpressure cylinder:

axle positioning means for shifting the axle of at least one cylinder of at least one of said first and second pairs of cylinders between a first position in which said rubber cloth cylinders of said first and second pairs are able to print on a strip of printable material passing between them and a second position in which said rubber cloth cylinders of said first and second cylinder pairs are spaced apart so that one of them can be driven while the other remains at rest and also for axle shifting from said second position such as to relatively approach or separate each of said rubber cloth cylinders of said first and second cylinder pairs, selectively, respectively to or from said counterpressure cylinder, respectively for printing and for flying plate change;

a main drive for providing rotary power for operating said printing press;

first operating means for operating said printing press in prime and verso offset-printing comprising;

first rotary force transmitting means for transmitting force from said main drive for driving said rubber cloth cylinder of both said first and second cylinder pairs when said axle positioning means is in said first position thereof, and means for driving a drive gear of said counterpressure cylinder with rotary force derived from said main drive whereby said counterpressure cylinder may serve as a feed-out cylinder for printed strip, and second means for operating said offset-printing press as a single-side printing press with facility for plate change without stopping the press, including:

first controllable power-transmission means for selectively driving either said rubber cloth cylinder of said first offset-printing cylinder pair or said rubber cloth cylinder of said second offset-printing cylinder pair by force derived from said main drive while the other of said first and second cylinder pairs is enabled to be disconnected from said main drive by said axle-positioning means, then subjected to a plate change and then brought back into connection with said main drive, and auxiliary drive means connectable for transmitting rotary force to said first or said second cylinder pair for putting into rotation and accelerating a said cylinder pair disconnected from said main drive and bringing it into synchronism for engagement with said main drive.

2. Rotary offset-printing press utilizing a multiple array of roller cylinders capable of dual-mode selective operation, either as a prime and verso offset printing press in which a strip to be printed may be printed simultaneously on both sides or else as a single-side printing press equipped for changing plates on the plate cylinder of a first pair of offset-printing cylinders while the press continues uninterruptedly to print with a second pair of offset-printing cylinders against a counterpressure cylinder common to both pairs of offset-printing cylinders and having an axle, each of said cylinder pairs including a plate cylinder and rubber-cloth surfaced cylinder, and comprising, in addition to said pairs of cylinders and said counterpressure cylinder:

a main drive for providing rotary power for operating said printing press;

axle positioning means for shifting the axle of at least the rubber cloth cylinder of at least one of said first and second pairs of cylinders between a first position in which said rubber cloth cylinders of said first and second pairs are both simultaneously able to print on a strip of printable material passing between them a second position in which said rubber cloth cylinders of said first and second cylinder pairs are spaced apart so that one of them can be driven while the other remains at rest and also for axle shifting such as to relatively approach or separate each of said rubber cloth cylinders of said first and second cylinder pairs, selectively, respectively to or from said counterpressure cylinder, respectively for printing and for flying plate change;

first operating means for operating said printing press in prime and verso offset-printing comprising:

first rotary force transmitting means for transmitting force from said main drive for driving said cylinders of said first and second cylinder pairs when said axle positioning means is in said first position thereof, and means for driving a drive gear of said counter-pressure cylinder with rotary force derived from said main drive whereby said counterpressure cylinder may serve as a feed-out cylinder for printed strip, and second means for operating said offset-printing press as a single-side printing press with facility for plate change without stopping the press, including:

means (6,7) for driving the axle (8) of said counterpressure cylinder (11) by force provided by said main drive;

first and second gears (11′, 11″) mounted concentrically on said axle (8) of said counterpressure cylinder (11) and first and second clutches (9, 10) for fixing and releasing, respectively, said first and said second gears for and from rotation with said axle (8) and thereby selectively driving either one or both of said rubber cloth cylinders (2,4) of said first and second cylinder pairs by means of gears (2′, 4′) respectively mounted on said rubber cloth cylinders;

gears (1′, 3′) respectively mounted on said plate cylinders of said first and second cylinder pairs for driving said plate cylinders by force transmitted from said gears (2′, 4′) of said rubber cloth cylinders of said cylinder pairs, said gear (3′) of said plate cylinder of said second cylinder pair being of more than the double of the width of said gear (1′) of said plate cylinder of said first cylinder pair, said gear (4′) of said rubber cloth cylinder of said second cylinder pair being axially shiftable;

second operating means for operating said printing press as a single-side printing press with facility for plate change without stopping the press, including:

means for shifting axially said gear (4′) of said rubber cloth cylinder of said second cylinder pair from a first position in which drive for said plate cylinder of second cylinder pair is provided by rotary power transmission from said first cylinder pair to a second position in which the drive of said plate cylinder of said second cylinder pair is provided by transmission of force from said second gear on said axle (8) of said counterpressure cylinder (11) and an auxiliary drive (12) and clutches (15,16) for selectively transmitting rotary force to one or another of the respective plate cylinders of said first and second cylinder pairs that is at rest following a plate change, for putting said plate cylinder into rotation and accelerating it into synchronism with said main drive.

3. Rotary offset-printing press according to claim 2, in which said rubber cloth cylinder (2) of said first cylinder pair is provided with first and second drive gears (2', 2''), said first drive gear (2') being provided for engagement with said axially shiftable drive gear (4') of said rubber cloth cylinder of said second cylinder pair and said second drive gear (2'') being provided for engagement with said first gear (11') of said counterpressure cylinder (11).

4. Rotary offset-printing press according to claim 2, whereby said first and second operating means are so constituted that said drive gear (2') of said first rubber cloth cylinder (2) of said first cylinder pair and said drive gear (4') of said rubber cloth cylinder (4) of said second cylinder pair remain engaged, both in prime and verso off-set printing and in single-side printing with flying plate change.

5. Rotary offset printing press utilizing a multiple array of roller cylinders capable of dual-mode selective operation, either as a prime and verso offset printing press in which a strip to be printed may be printed simultaneously on both sides or else as a single-side printing press equipped for changing plates on the plate cylinder of a first pair of offset printing cylinders while the press continues uninterruptedly to print with a second pair of offset printing cylinders against a counterpressure cylinder common to both pairs of offset-printing cylinders, each of said cylinder pairs including a plate cylinder and a rubber-cloth-surfaced cylinder, and comprising, in addition to said pairs of cylinders and said counterpressure cylinder:

axle positioning means for shifting the axle of at least one cylinder of at least one of said first and second pairs of cylinders between a first position in which said rubber cloth cylinders of said first and second pairs are able to print simultaneously on a strip of printable material passing between them while said counterpressure cylinder is spaced away from said rubber cloth cylinders of both said cylindear pairs and a second position in which said rubber cloth cylinders of said first and second cylinders pairs are spaced apart so that one of them can be driven while the other remains at rest and also for axle shifting from said second position such as to relatively approach or separate each of said rubber cloth cylinders of said first and second cylinder pairs, selectively, respectively to or from said counterpressure cylinder, respectively for printing and for flying plate change;

a main drive, for providing rotary power at least a first output gear of said main drive for operating said printing press;

first operating means for operating said printing press in prime and verso offset-printing comprising;

first gear means for transmitting rotary force from said first output gear of said main drive to a drive gear of said plate cylinder of said first pair of offset-printing cylinders;

second gear means for transmitting rotary force from said drive gear of said plate cylinder of said first pair of offset-printing cylinders to a drivea gear of the plate cylinder of said second pair of offset-printing cylinders, and means for driving a drive gear of said counterpressure cylinder with rotary force derived from said main drive whereby said counterpressure cylinder may serve as a feed-out roller for printed strip, and second operating means for operating said offset-printing press as a single-side printing press with facility for plate change without stopping the press, including:

controllable power-transmission means for selectively driving either said rubber cloth cylinder of said first offset-printing roller pair or said rubber cloth cylinder of said second offset-printing cylinder pair by force transmitted from said drive gear of said counterpressure cylinder for printing said strip against said counterpressure cylinder by said cylinder pair so driven, said controllable power transmission means comprising first driving gears respectively for said rubber cloth cylinders second driving gears in driving engagement with said driving gear of said counterpressure cylinder and clutches for connecting said second driving gears alternately to a corresponding one of said first driving gears, means for removing said first gear means from power-transmitting engagement during operation of said offset printing press as a single-side printing press and an auxiliary drive for use in operation of said offset-printing press as a single-side printing press with facility for plate change without stopping the press, comprising a motor, a first drive gear for driving said plate cylinder of said first pair of offset printing cylinders with force derived from said motor, a second drive gear for driving said plate cylinder of said second pair of offset-printing cylinders and clutch means for alternately driving said first drive gear or said second drive gear by force from said motor for bringing one or the other of said plate cylinders from rest up to an operating speed matching the speed of said counterpressure cylinder preparatory to operating said controllable power transmission of said second means for operating said offset printing press as a single-side printing press for driving the rubber cloth cylinder of the cylinder pair of which the plate cylinder has been brought up to operating speed by said auxiliary drive.

6. Rotary offset printing press according to claim 5, wherein said first drive gear of said auxiliary drive has a longer axial dimension and thereby a greater gear width than said second drive gear of said auxiliary drive and wherein said first driving gears of said rubber cloth cylinder are placed in direct engagement in said first position of said axle-shifting means and are placed in position for both being driven by said drive gear of said counterpressure cylinder in said second position of said axle-shifting means.

* * * * *